US011524750B1

(12) United States Patent
Galloway

(10) Patent No.: US 11,524,750 B1
(45) Date of Patent: Dec. 13, 2022

(54) HULL FOR A WAKESURF BOAT

(71) Applicant: James Southwick Galloway, Carpinteria, CA (US)

(72) Inventor: James Southwick Galloway, Carpinteria, CA (US)

( * ) Notice: Subject to any disclaimer, the term of this patent is extended or adjusted under 35 U.S.C. 154(b) by 4 days.

(21) Appl. No.: 17/060,674

(22) Filed: Oct. 1, 2020

Related U.S. Application Data

(60) Provisional application No. 62/974,887, filed on Dec. 30, 2019.

(51) Int. Cl.
*B63B 1/04* (2006.01)
*B63B 32/50* (2020.01)

(52) U.S. Cl.
CPC ..... *B63B 32/50* (2020.02); *B63B 1/04* (2013.01)

(58) Field of Classification Search
CPC .... B63B 1/06; B63B 1/08; B63B 1/04; B63B 32/50
USPC ..... 114/61.27, 61.28, 61.29, 61.3, 61.31, 114/61.32, 61.33
See application file for complete search history.

(56) References Cited

U.S. PATENT DOCUMENTS 2,960,957 A * 11/1960 Eddy ..... B63B 1/04 114/271
5,394,819 A * 3/1995 Aarnio ..... B63B 1/04 114/271
6,116,180 A * 9/2000 Thompson ..... B63B 1/04 114/271
6,843,193 B1 * 1/2005 Alvarez-Calderon F. ..... B63B 39/061 114/61.3

FOREIGN PATENT DOCUMENTS

DE 202010008935 U1 * 1/2011 ..... B63B 1/08

* cited by examiner

*Primary Examiner* — Anthony D Wiest
(74) *Attorney, Agent, or Firm* — Ted Masters

(57) ABSTRACT

A hull for a wakesurf boat includes an upper hull which is joined to a lower hull. The lower hull has a length, a maximum depth, a maximum width, a forward end, and an aft end. The lower hull is tapered toward the forward end and is largest at the aft end. In an embodiment, the maximum depth of the lower hull is less than 40% of the maximum width. In another embodiment the taper is a linear taper. The lower hull can include chines or can be rounded.

2 Claims, 6 Drawing Sheets

FIG. 10
PRIOR ART
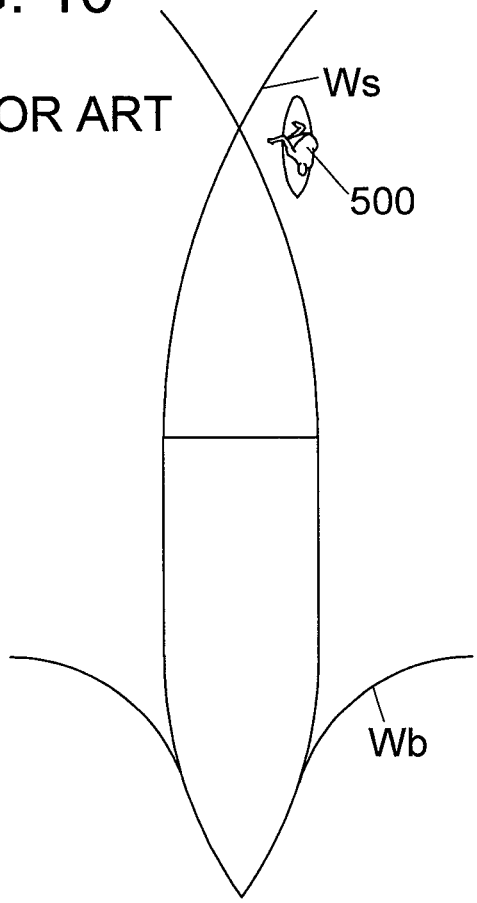
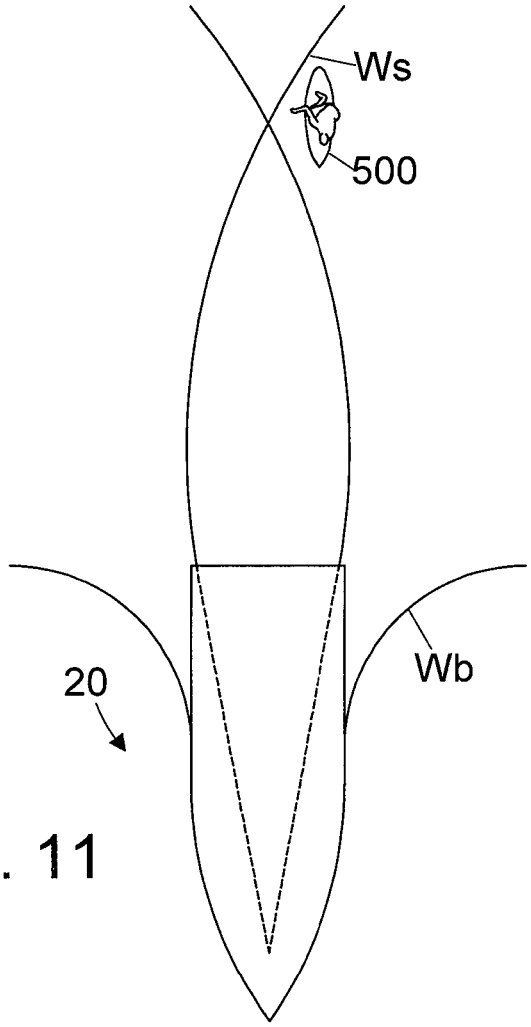
FIG. 11

HULL FOR A WAKESURF BOAT

CROSS REFERENCE TO RELATED APPLICATION

This application claims the filing benefit under 35 U.S.C. § 119(e) of U.S. Provisional Application No. 62/974,887, filed Dec. 30, 2019 which is hereby incorporated by reference.

TECHNICAL FIELD

The present invention pertains generally to boats, and more particularly to a hull for a wakesurf boat.

BACKGROUND OF THE INVENTION

The sport of wakesurfing has been around for decades. A wake surfer starts off by being towed behind a heavy boat. When the boat reaches a non-planing speed of 10 to 15 mph, a stern wave forms behind the boat. At that point the wake surfer releases the rope and can continue to surf entirely by the force of the stern wave alone. The heavy boat gouges out a trough below the waterline, and it is within and to the side of this trough where the surfer performs his surfing maneuvers. The higher side of the trough toward the boat's centerline is the wave face that resembles an ocean wave. The trough and wave face have certain characteristics, one of which surfers call the "transition". The transition refers to the steepness of the edge of the trough and the wave face. Surfers generally desire a transition that is not too steep and a trough that is as wide as possible.

Creating a boat-generated surfable wave requires a heavy ballasted boat moving forward at a non-planing speed of 10 to 15 miles per hour. At the boat's transom the trough may be 2 to 3 feet deep at which point there are significant water flows from the port, starboard and bottom sides resulting in water in-fill behind the boat when the boat is moving forward under power. These water flows converge behind the boat to create the stern wave. This surfable wave is, in fact, the second wave produced by the boat. The first wave is pushed out from the bow and is referred to as the bow wave. Water ballast systems are widely utilized in current wakesurf boats. Propulsion means can include either inboard or outboard motors. U.S. Pat. No. 9,242,700 discloses a typical wakesurf boat.

It should be further noted that virtually all existing wakeboard and wakesurf boats are multipurpose vessels. They can be used for waterskiing and cruising, generally at speeds in excess of 23 mph, wakeboarding generally at speeds of 16 to 23 mph, and wakesurfing generally at speeds of 10 to 15 mph. All of these hull designs require a stable overall configuration that deviate only slightly from various other planing hulls known in the art for over 75 years. These standard hulls have substantially parallel sides, and a rounded bow that pushes out a bow wave near the bow. These multipurpose designs are inefficient for generating the ideal wake for wakesurfing.

Current wakesurf boats have two problems. The first and most troublesome is that wakesurfing is done too close to the back of the boat. The second objection is surfing in a trough that is too narrow and/or has a transition that is too steep. As noted above the surfer is actually riding the second wave produced by the boat. When a first wave is produced as a result of force applied to a body of water, it is natural for a trough and second wave to form behind it. The distance between the first and second wave is the wave interval and should be a naturally occurring distance based on the force and speed applied to the body of water.

However, the natural wave interval is interrupted by a standard hull effectively blocking the trough and second wave that would naturally form behind the first wave. The water flow that would otherwise create a trough, then a second wave is, instead, disrupted, and "squeezed" along a standard hull just behind the midship and stern. The water pressure resulting from this squeezing is suddenly release at the transom where the water cascades behind the boat and too quickly in-fills the trough, resulting in a stern wave forming too close to the transom.

BRIEF SUMMARY OF THE INVENTION

The present invention is directed to a wakesurf-specific hull which is designed only for the purpose of wakesurfing at a speed of about 10 to 15 mph. The hull for a wakesurf boat is specially designed to create a wide, soft transition and a bow wave near the stern instead of the bow, thereby, resulting in a stern wave forming farther back. The displacement hull includes an upper hull portion which is mostly above the waterline and a lower hull portion that is mostly below the waterline. The upper hull portion resembles a normal boat with a bow, midship and stern, and, more specifically, resembles a skiff. The lower hull has a tapered wedge shape that starts out narrow and shallow at the front of the lower hull portion and flares to deepest and widest at the back of the lower hull portion adjacent the transom.

The tapered wedge shape has sloping sides with moderate angles of slope and a bottom surface. While under power moving forward at a non-planing speed of 10 to 15 miles per hour, the tapered wedge shape produces a bow wave near the stern of the boat instead of near the bow as in standard boats. This delays the stern wave further behind the transom of the boat. When the hull is moving forward at a non-planing speed of 10 to 15 miles per hour, the straight sides tend to divert the water to either side and back, rather than forward as is the case with a standard curved hull, resulting in the primary first wave or bow wave being generated closer to the stern compared to standard wakeboard boats.

Producing the bow wave closer to the stern has the effect of moving the second stern wave farther back. The reason for this result can be described two different ways. The first way of describing this effect is due to wave theory. When one wave is produced by applying a displacement force to water, based on the speed and weight applied, a trough and secondary wave will form behind the first wave at a natural interval. Therefore, theoretically, if the first wave is formed farther back, the second wave will form farther back. The second way of describing this effect is due to water flow. Since the hull flares all the way to the very back of the hull, there is an outward flow of water around the transom, as compared to a standard hull that has a parallel flow of water around the transom. The outward flow of water delays the convergence which occurs behind the boat, thereby, delaying the formation of the stern wave.

The present invention also has a hull shape which broadens and softens the transition, allowing the surfer a wider area in which to surf with little threat of catching the outside rail of the surfboard. This is accomplished by further defining the shape of the lower hull when viewed from behind the hull.

In accordance with an embodiment, a hull for a wakesurf boat includes an upper hull which is joined to a lower hull, the upper hull having a centerline. The lower hull has a length, a maximum depth, a maximum width, a forward end, and an aft end, the lower hull is tapered toward the forward end. The lower hull is largest at the aft end.

In accordance with another embodiment, the maximum depth of the lower hull is less than 40% of the maximum width.

In accordance with another embodiment, the taper is a linear taper.

In accordance with another embodiment, the lower hull has an aft section, the aft section including an aftmost one-third of the lower hull, all cross sections of the aft section of the lower hull taken along the centerline having the same shape;

In accordance with another embodiment, all cross sections of the lower hull taken along the centerline from the aft end to the forward end have the same shape.

In accordance with another embodiment, the lower hull has a vertical taper of the maximum depth divided by the length, in which the vertical taper ranges from 0.1 to 0.2.

In accordance with another embodiment, the lower hull has a transverse taper of the maximum width divided by the length, in which the transverse taper ranges from 0.14 to 0.5.

In accordance with another embodiment, the lower hull has a cross section at the aft end, the cross section including a plurality of chines. The chines define a partial ellipse having a semi-minor axis of about the maximum depth and a major axis of about the maximum width.

In accordance with another embodiment, the lower hull includes a plurality of planar hull segments.

In accordance with another embodiment, the planar hull segments have a triangular shape.

In accordance with another embodiment, the lower hull has a cross section at the aft end, the cross section being rounded.

In accordance with another embodiment, the cross section at the aft end forms a partial ellipse having a semi-minor axis of about the maximum depth and a major axis of about the maximum width.

At the aft end the lower hull has a port side having a port top, and a starboard side having a starboard top. A midpoint Is disposed exactly half way between the port top and the starboard top. No part of the lower hull extends further away than one half the maximum width from the midpoint.

Other embodiments, in addition to the embodiments enumerated above, will become apparent from the following detailed description, taken in conjunction with the accompanying drawings, which illustrate, by way of example, the principles of the hull for a wakesurf boat.

BRIEF DESCRIPTION OF THE DRAWINGS

FIG. 10 is a reduced top plan view of a prior art wakesurf boat hull creating a wave with a surfer surfing the wave;

FIG. 11 is a reduced top plan view of a the present wakesurf boat hull creating a wave with a surfer surfing the wave;

Figure 21:
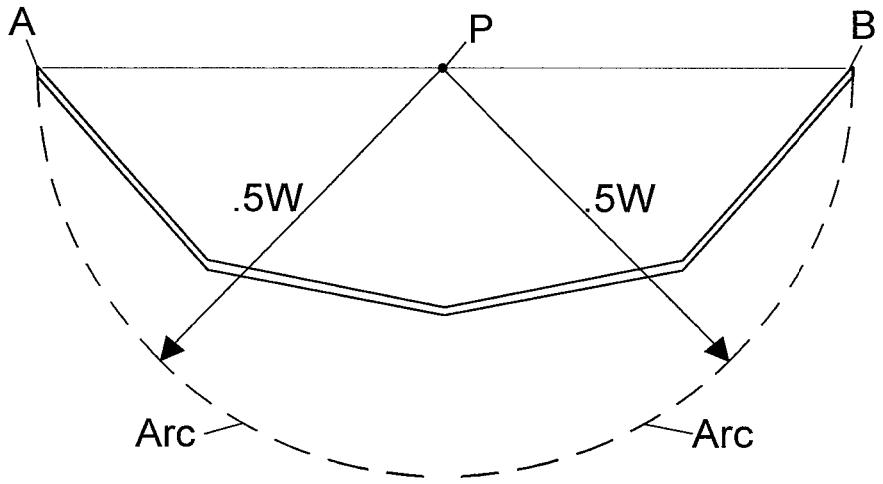

and,

FIG. 21 is an enlarged cross sectional view of the aft end of the lower hull.

DETAILED DESCRIPTION OF THE INVENTION

Figure 7:
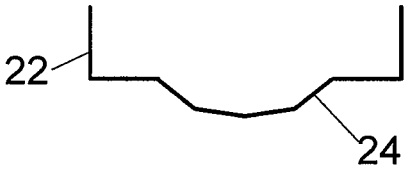
FIG. 7 is a cross sectional view along the line 7-7 of FIG. 2.
Figure 8:
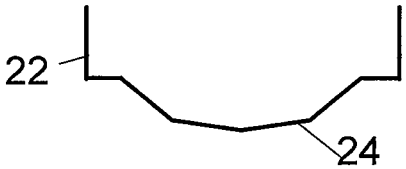
FIG. 8 is a cross sectional view along the line 8-8 of FIG. 2.
Figure 9:
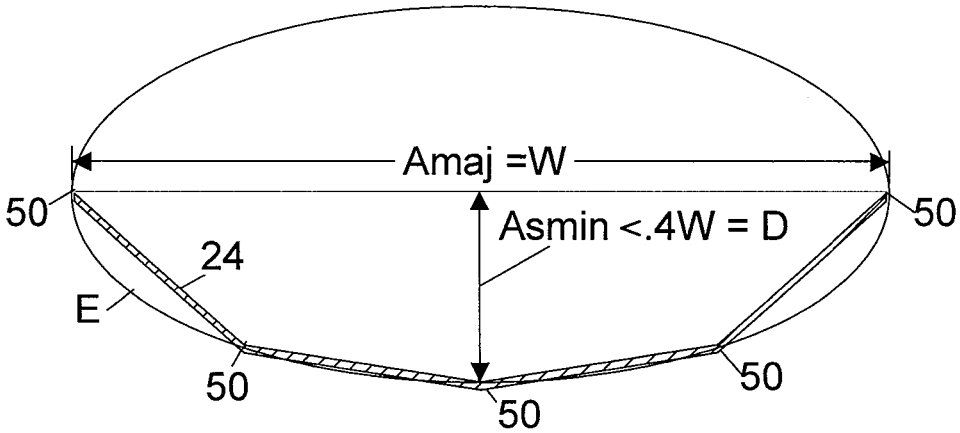
FIG. 9 is an enlarged cross sectional view along the line 9-9 of FIG. 2.
Figure 12:
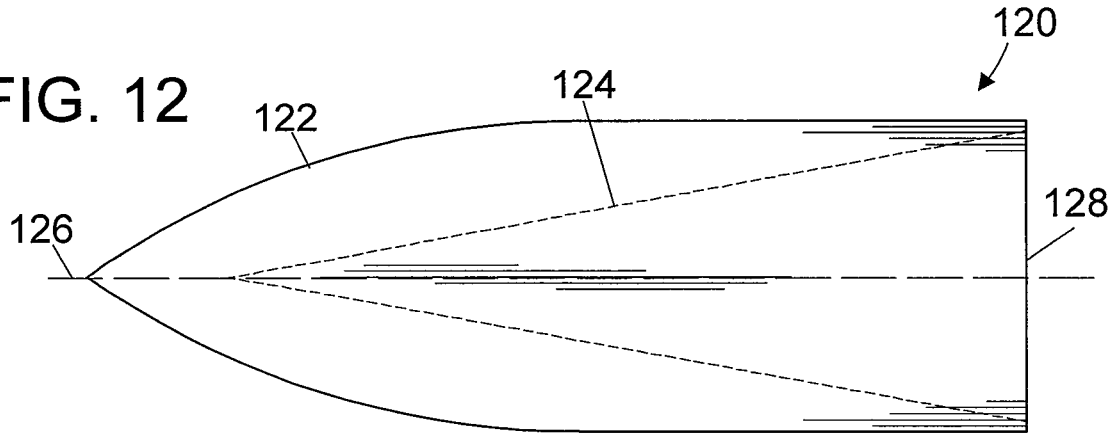
FIG. 12 is a top plan view of a second embodiment hull for a wakesurf boat.

Referring initially to FIGS. 1-6, there are illustrated top plan, bottom plan, bottom perspective, side elevation, front elevation, and rear elevation views respectively of a hull for a wakesurf boat generally designated as 20. FIGS. 7-9 show various cross sectional views. Hull 20 includes an upper hull 22 which is joined to a lower hull 24. Upper hull 22 has a centerline 26. It may be appreciated that while only the hull 20 is shown, the actual wakesurfboat would typically further include a deck, a navigation system, a propulsion means, and other necessary outfitting items. In use, upper hull 22 generally resides above the waterline WL, and lower hull 24 generally resides below the water line WL (refer to FIG. 4). It is lower hull 24 which produces a surfable wave. At the aft end of hull 20, a transom 28 is transversely connected to upper hull 22 and lower hull 24. Transom 28 has a upper portion which is generally resides above the waterline WL, and a lower portion which is generally resides below the waterline WL. In the shown embodiment transom 28 is perpendicular to centerline 28. In the shown embodiment lower hull 24 is disposed symmetrically about centerline 28, however asymmetrical lower hull shapes are also possible. Also in the shown embodiment, upper hull 22 includes a flat portion 23. Lower hull 24 has a forward end 30 and an opposite aft end 32, a length L along centerline 26, a maximum depth D (at aft end 32), and a maximum width W (at aft end 32). In an embodiment, maximum depth D of lower hull 24 is less than 40% of maximum width W (0.4W), with a preferred depth D of about 30% of maximum width W. Lower hull 24 is tapered toward forward end 30. That is, starting at aft end 32 lower hull 24 becomes progressively smaller as it approaches forward end 30. Lower hull 24 is largest at aft end 32. In the shown embodiment forward end 30 converges to a point. However, forward end 30 could also be truncated (for example be slightly rounded). In this case the forward end 30 would be defined as the point at which the taper starts.

In the shown embodiment the taper of lower hull 24 is a linear taper. This means that the lower hull 24 tapers along a straight line from aft end 32 to forward end 30. As such, in the shown embodiment all cross sections of lower hull 24 taken along centerline 26 from aft end 32 to forward end 30 have the same shape (but not the same size). The size of the cross sections progresses from largest at aft end 32 to smallest at forward end 30. FIGS. 7, 8, and 9 show cross sections of lower hull 24 taken at three locations along centerline 26, and all cross sections have the same shape because of the linear taper. In another embodiment, referring to FIGS. 2, 7, 8, and 9, it is noted that lower hull 24 has an aft section 25, aft section 25 includes an aftmost (rearmost) one-third of lower hull 24. That is, aft section 25 has a length of L/3. In an embodiment all cross sections of aft section 25 of lower hull 24 taken along centerline 26 have the same shape. In this embodiment, cross sections taken along the forward two-thirds of lower hull 24 could have a different configuration and therefore not have the same shape.

Figure 4:
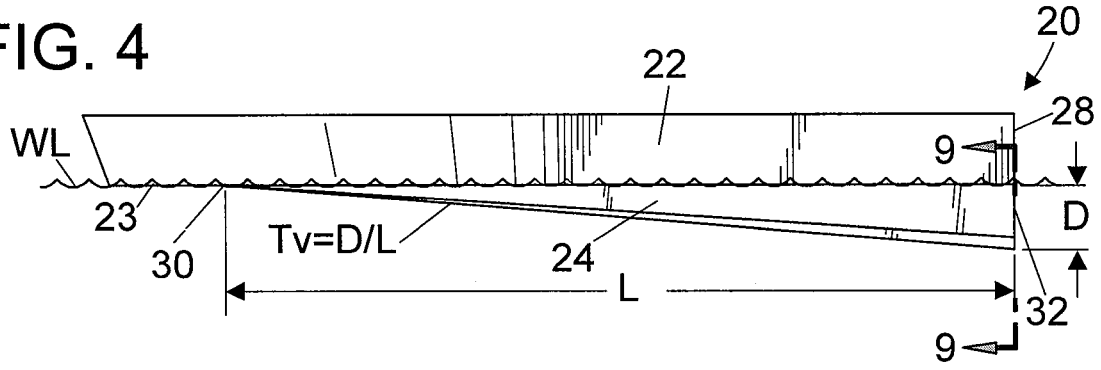
FIG. 4 is a side elevation view of the hull for a wakesurf boat.
Figure 5:
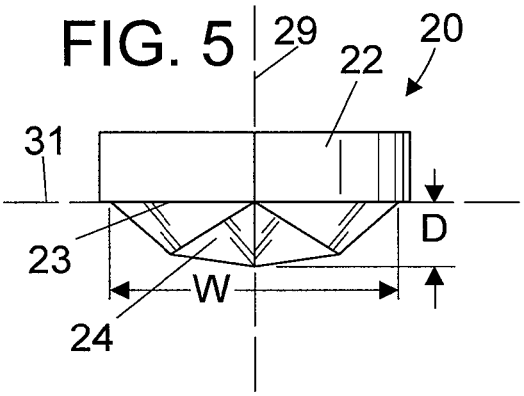
FIG. 5 is a front elevation view of the hull for a wakesurf boat.
Figure 6:
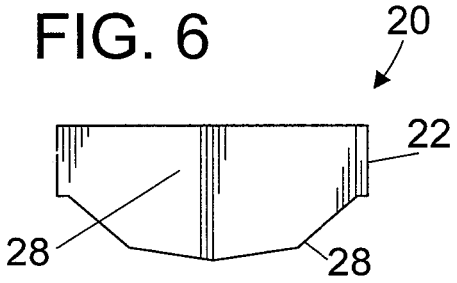
FIG. 6 is a rear elevation view of the hull for a wakesurf boat.

Referring specifically to FIG. 4, the linear taper includes a vertical taper Tv which is defined as maximum depth D divided by length L (Tv=D/L). In an embodiment vertical taper Tv ranges from about 0.1 to about 0.2. As used herein "vertical" refers to vertical axis 29 as shown in FIG. 5.

Figure 1:
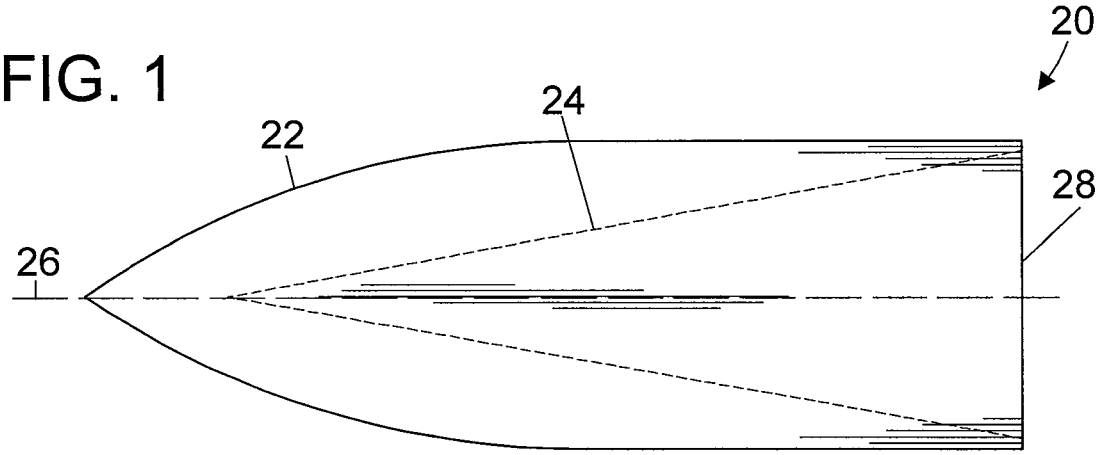
FIG. 1 is a top plan view of a hull for a wakesurf boat.
Figure 2:
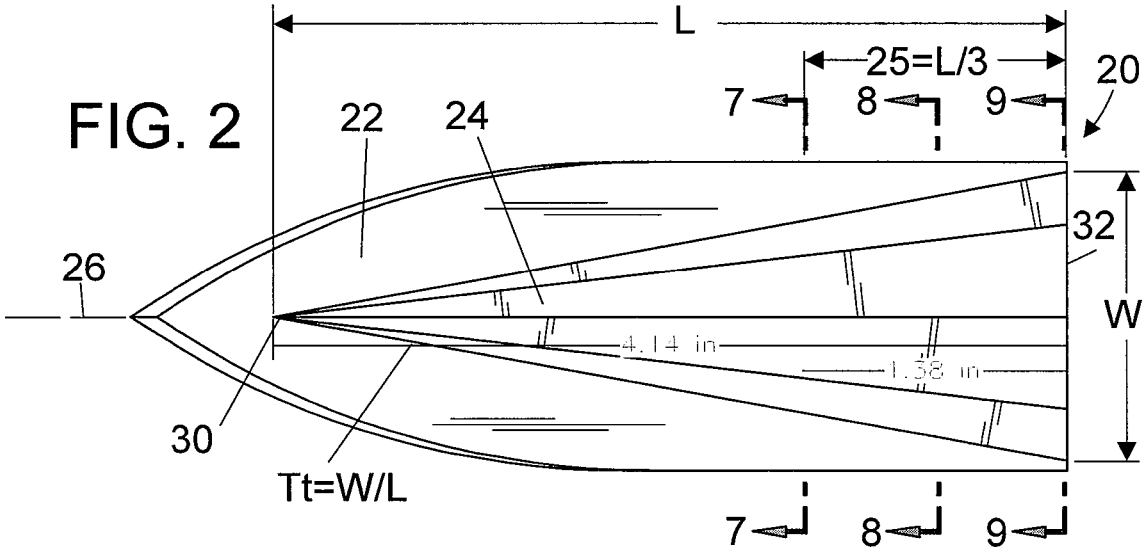
FIG. 2 is a bottom plan view of the hull for a wakesurf boat.
Figure 3:
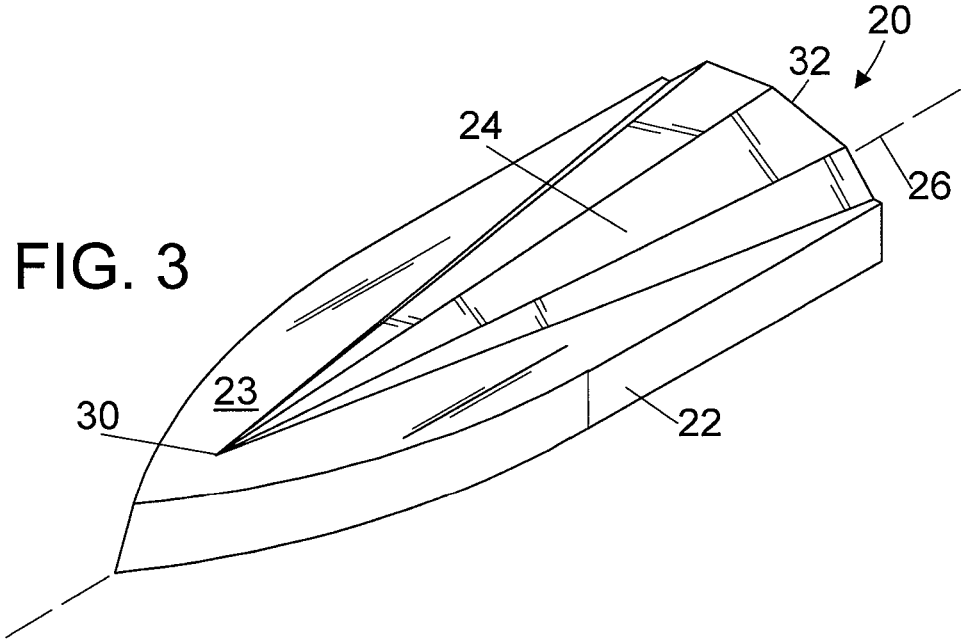
FIG. 3 is a bottom perspective view of the hull for a wakesurf boat.

Referring specifically to FIG. 2, the linear taper includes a transverse taper Tt which is defined as maximum width W divided by length L (Tt=W/L). In an embodiment transverse taper Tt ranges from about 0.14 to about 0.5. As used herein "transverse" refers to transverse axis 31 as shown in FIG. 5.

In the embodiment shown in FIGS. 1-9, hull 20 has a chine design in which angles exist in the cross sectional views (FIGS. 7-9). This usually occurs when sheet materials are used to create hull segments. A chine is formed at the intersection of two hull segments. The chine angle can be "hard" with little rounding as shown, or can be "soft" with some rounding. Because of the linear tapering in the present wakesurf hull 20, lower hull 24 includes a plurality of planar hull segments, each of which have a triangular shape. Four planar hull segments are shown, however other numbers such as two, six, eight, ten, etc are also possible. It is noted in FIGS. 2, 3, and 5 that the boundaries between planar hull segments form a straight line in accordance with the linear taper.

Referring specifically to FIG. 9, lower hull 24 has a cross section at aft end 32, the cross section includes a plurality of chines 50. In an embodiment, the chines generally define a partial ellipse E having a semi-minor axis Asmin of maximum depth D, and a major axis Amaj of about maximum width W. As discussed above, in an embodiment maximum depth D is less than 40% of maximum width W. In the shown embodiment partial ellipse E is the lower half of the ellipse shown in FIG. 9.

FIG. 10 is a reduced top plan view of a prior art wakesurf boat hull creating a wave with a surfer 500 surfing the wave. FIG. 11 is a reduced top plan view of the present wakesurf boat hull 20 creating a wave with a surfer 500 surfing the wave. It is noted in FIG. 11 that both the bow wave Wb and stern wave Ws are moved back in the case of wakesurf boat hull 20.

Figure 18:
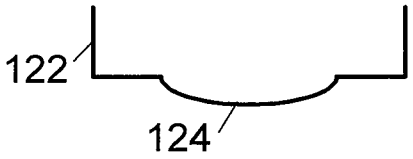
FIG. 18 is a cross sectional view along the line 18-18 of FIG. 13.
Figure 19:
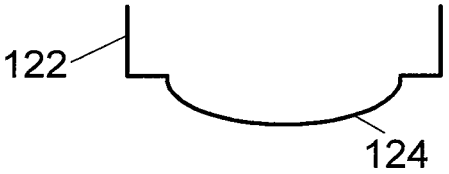
FIG. 19 is a cross sectional view along the line 19-19 of FIG. 13.
Figure 20:
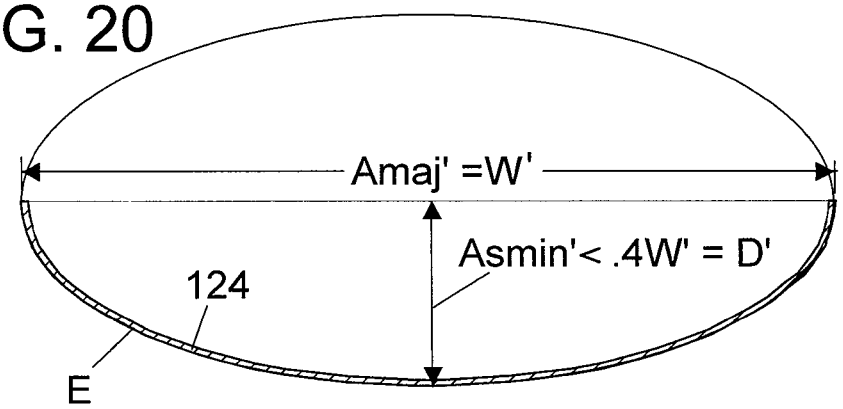
FIG. 20 is an enlarged cross sectional view along the line 20-20 of FIG. 13.

Now referring to FIGS. 12-17 there are illustrated top plan, bottom plan, bottom perspective, side elevation, front elevation, and rear elevation views respectively of a second embodiment hull for a wakesurf boat generally designated as 120. FIGS. 18-20 show various cross sectional views. Hull 120 includes an upper hull 122 which is joined to a lower hull 124. In this embodiment lower hull 124 is rounded, which can further smooth out the trough that forms behind the boat, thereby further improving the stern wave for surfing.

Upper hull 122 has a centerline 126. It may be appreciated that while only the hull 120 is shown, the actual wakesurf-boat would typically further include a deck, a navigation system, a propulsion means, and other necessary outfitting items. In use, upper hull 122 generally resides above the waterline WL, and lower hull 124 generally resides below the water line WL (refer to FIG. 15). It is lower hull 124 which produces a surfable wave. At the aft end of hull 122, a transom 128 is transversely connected to upper hull 122 and lower hull 124. Transom 128 has a upper portion which is generally resides above the waterline WL, and a lower portion which is generally resides below the waterline WL. In the shown embodiment transom 128 is perpendicular to centerline 128. In the shown embodiment lower hull 124 is disposed symmetrically about centerline 126, however asymmetrical lower hull shapes are also possible. Also in the shown embodiment, upper hull 122 includes a flat portion 123.

Lower hull 124 has a forward end 130 and an opposite aft end 132, a length L' along centerline 126, a maximum depth D' (at aft end 132), and a maximum width W' (at aft end 32). In an embodiment, maximum depth D' of lower hull 24 is less than 40% of maximum width W' (0.4W'), with a preferred depth D' of about 30% of maximum width W'. Lower hull 124 is tapered toward forward end 130. That is, starting at aft end 132 lower hull 124 becomes progressively smaller as it approaches forward end 130. Lower hull 124 is largest at aft end 132. In the shown embodiment forward end 130 converges to a point. However, forward end 130 could also be truncated (for example be slightly rounded). In this case the forward end 130 would be defined as the point at which the taper starts.

In the shown embodiment the taper of lower hull 124 is a linear taper. This means that the lower hull 124 tapers along a straight line from aft end 132 to forward end 130. As such, in the shown embodiment all cross sections of lower hull 124 taken along centerline 126 from aft end 132 to forward end 130 have the same shape (but not the same size). The size of the cross sections progresses from largest at aft end 132 to smallest at forward end 130. FIGS. 18, 19, and 20 show cross sections of lower hull 124 taken at three locations along centerline 126, and all cross sections have the same shape because of the linear taper. In another embodiment, referring to FIGS. 13, 18, 19, and 20, it is noted that lower hull 124 has an aft section 125, aft section 125 includes an aftmost (rearmost) one-third of lower hull 124. That is, aft section 125 has a length of L'/3. In an embodiment all cross sections of aft section 125 of lower hull 24 taken along centerline 126 have the same shape. In this embodiment, cross sections taken along the forward two-thirds of lower hull 124 could have a different configuration and therefore not have the same shape.

Figure 15:
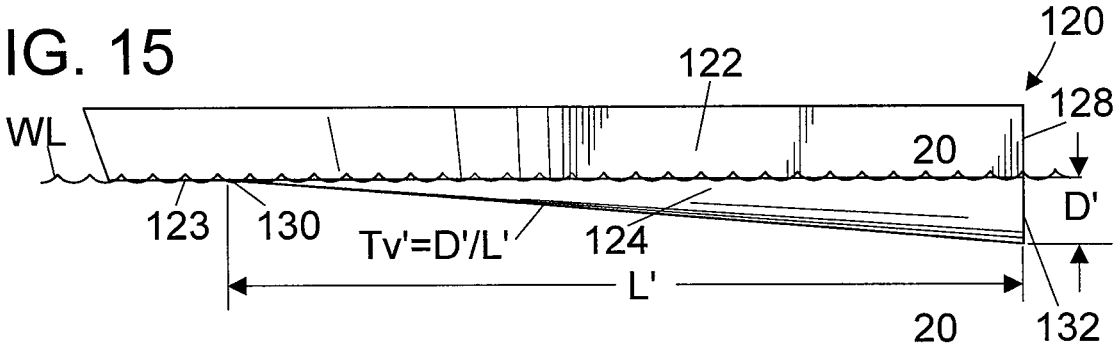
FIG. 15 is a side elevation view of the second embodiment hull for a wakesurf boat.
Figure 16:
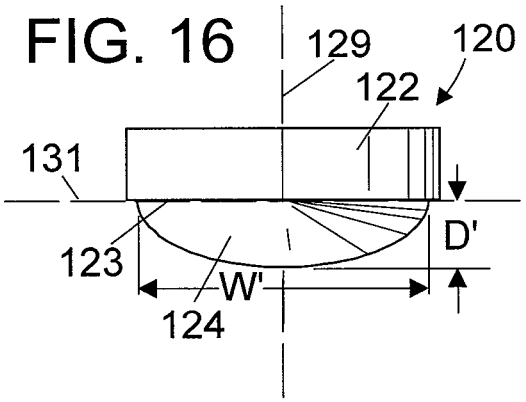
FIG. 16 is a front elevation view of the second embodiment hull for a wakesurf boat.
Figure 17:
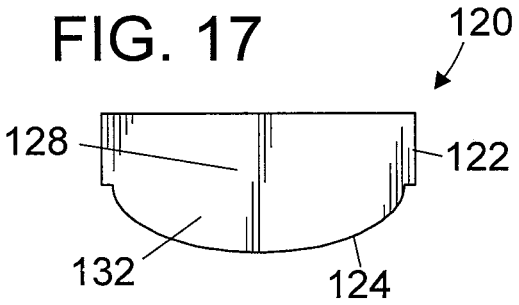
FIG. 17 is a rear elevation view of the second embodiment hull for a wakesurf boat.

Referring specifically to FIG. 15, the linear taper includes a vertical taper Tv' which is defined as maximum depth D' divided by length L' (Tv'=D'/L'). In an embodiment vertical taper Tv' ranges from about 0.1 to about 0.2. As used herein "vertical" refers to vertical axis 129 as shown in FIG. 16.

Figure 13:
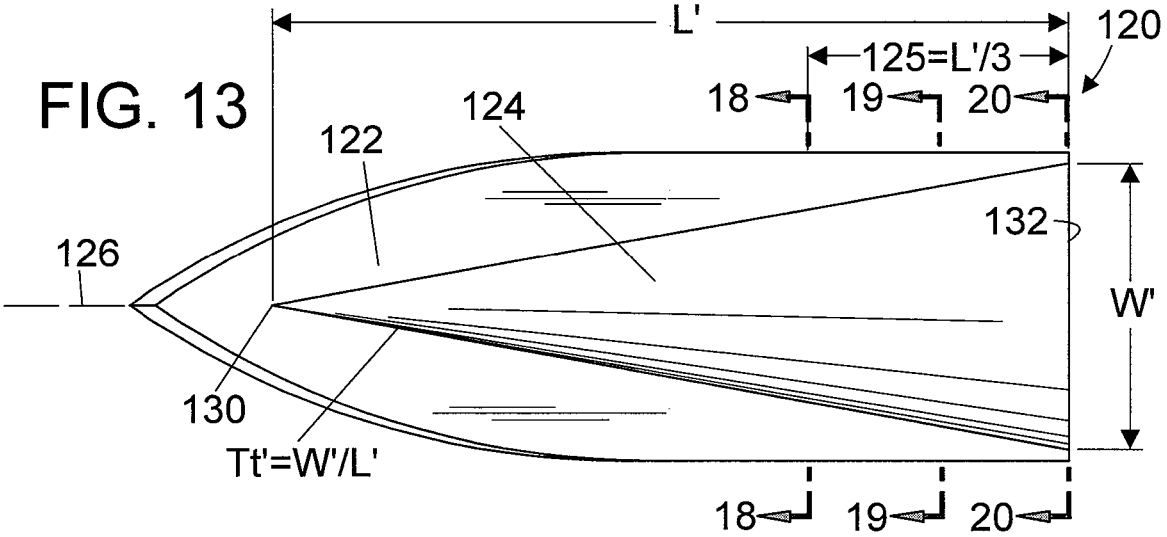
FIG. 13 is a bottom plan view of the second embodiment hull for a wakesurf boat.
Figure 14:
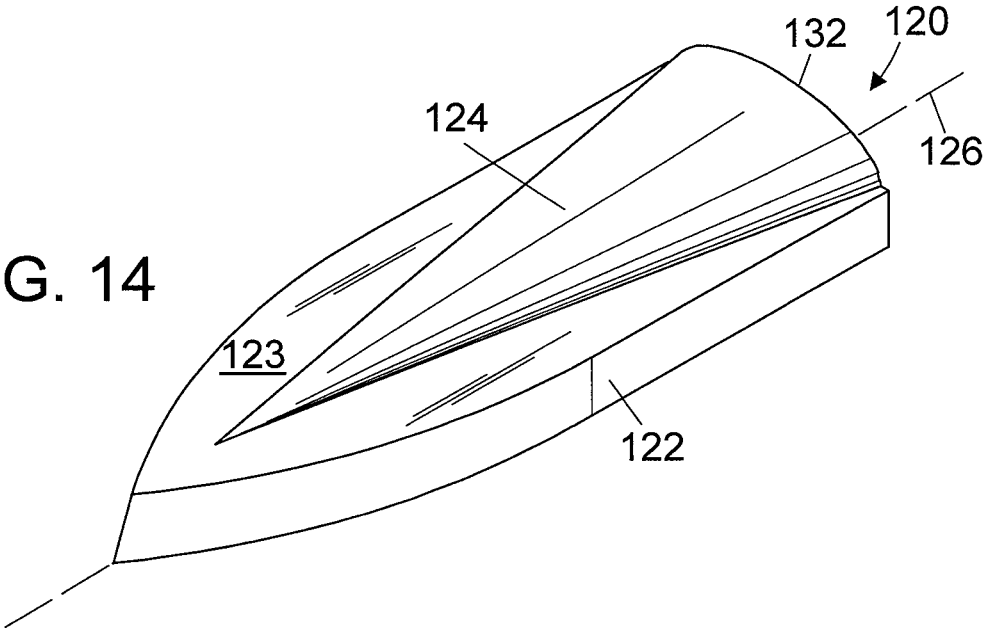
FIG. 14 is a bottom perspective view of the second embodiment hull for a wakesurf boat.

Referring specifically to FIG. 13, the linear taper includes a transverse taper Tt' which is defined as maximum width W' divided by length L' (Tt'=W'/L'). In an embodiment transverse taper Tt' ranges from about 0.14 to about 0.5. As used herein "transverse" refers to transverse axis 131 as shown in FIG. 16.

In the second embodiment wakesurf hull 120, lower hull 124 is rounded. That is, lower hull 124 has a cross section, and the cross section has a rounded shape (refer to FIG. 20). Referring specifically to FIG. 20, in an embodiment the cross section of lower hull 124 at aft end 132 generally forms a partial ellipse E which has a semi-minor axis Asmin' of about maximum depth D' and a major axis Amaj' of about maximum width W'. As discussed above, in an embodiment maximum depth D' is less than 40% of maximum width W'. In the shown embodiment partial ellipse E is the lower half of the ellipse shown in FIG. 20.

It is noted that the second embodiment hull 120 of FIGS. 12-20 produces about the same wave as was previously discussed under FIGS. 10-11 above.

FIG. 21 is an enlarged cross sectional view of the aft end 32 of the lower hull 24. The aft end 32 of lower hull 24 has a port side having a port top A, and a starboard side having a starboard top B. A midpoint P is disposed exactly half way between port top A and starboard top B. No part of lower hull 24 extends further than one half maximum width (0.5W) away from midpoint P (broken line labeled as Arc). This feature ensures that lower hull 24 is not too steep which has been found undesirable for wave production. While FIG. 21 shows a hull having chines (FIGS. 1-9), it may be appreciated that the above discussion is also applicable to the rounded hull of FIGS. 12-20.

Comments on the Efficacy of the Present Wakesurf Hull:

The tapered lower hull with the largest part at the aft end is a design which diverts more water flow to the stern as compared to a standard hull which is more curved at the forward end with generally parallel sides at the aft end. In the present design water flows outward and downward at the aft end, compared to parallel with a standard hull. This outward flow of water delays the convergence of water into the trough behind the boat, thereby, delaying the formation of the stern wave.

Limiting the depth of the lower hull to 40% of the width further defines a hull which creates a trough behind the boat that is wide enough for the stern wave to be surfable. The shape of the trough behind the boat is initially the same shape as the transom. Since that shape has significantly more width than depth, the trough will be wide enough relative to its depth so that the resulting trough and the stern wave will be surfable with a wide latitude in which a surfer can perform surfing maneuvers. A preferred depth is about 30% of the width.

The linear taper defines the hull as being even more streamline in diverting the water flow to the aft end of the boat. With minimal or no curve in the hull, the water flows transmit more efficiently to the aft end, moving the bow wave further back and moving the stern wave further back.

The above cited features have been verified experimentally.

The vertical taper should by at least 0.1 to have the desired effect of moving the bow wave back and should be no more than 0.2 in order for the boat to operate in a stable and efficient manner. A preferred taper is about 0.125. This allows for a significant downward flow of water at the aft end while enabling a shaft angle for an inboard motor which is not too steep.

The transverse taper should be less than 0.5 and should be at least 0.14 in order for the boat to operate in a stable and efficient manner. A preferred transverse taper is about 0.2. This allows for a reasonable boat length relative to its width.

The embodiments of the hull for a wakesurf boat described herein are exemplary and numerous modifications, combinations, variations, and rearrangements can be readily envisioned to achieve an equivalent result, all of which are intended to be embraced within the scope of the appended claims. Further, nothing in the above-provided discussions of the hull for a wakesurf boat should be construed as limiting the invention to a particular embodiment or combination of embodiments. The scope of the invention is defined by the appended claims.

I claim:

1. A hull for a wakesurf boat, comprising:

an upper hull which is joined to a lower hull, said upper hull having a centerline:

said lower hull having a length, a maximum depth, a maximum width, a forward end, and an aft end, said lower hull being tapered toward said forward end;

said lower hull being largest at said aft end;

said maximum depth of said lower hull being less than 40% of said maximum width;

said taper being a linear taper;

said lower hull having an aft section, said aft section including an aftmost one-third of said lower hull;

all cross sections of said aft section of said lower hull taken along said centerline having the same shape;

said lower hull having a vertical taper of said maximum depth divided by said length;

said vertical taper ranging from 0.1 to 0.2;

said lower hull having a transverse taper of said maximum width divided by said length;

said transverse taper ranging from 0.14 to 0.5;

said lower hull including a plurality of planar hull segments; and, said planar hull segments having a triangular shape.

2. A hull for a wakesurf boat, comprising:

an upper hull which is joined to a lower hull, said upper hull having a centerline:

said lower hull having a length, a maximum depth, a maximum width, a forward end, and an aft end, said lower hull being tapered toward said forward end;

said lower hull being largest at said aft end;

said maximum depth of said lower hull being less than 40% of said maximum width;

said taper being a linear taper;

said lower hull having an aft section, said aft section including an aftmost one-third of said lower hull; and, all cross sections of said aft section of said lower hull taken along said centerline having the same shape;

said lower hull having a vertical taper of said maximum depth divided by said length;

said vertical taper ranging from 0.1 to 0.2;

said lower hull having a transverse taper of said maximum width divided by said length;

said transverse taper ranging from 0.14 to 0.5;

said lower hull having a cross section; and, said cross section being rounded.

* * * * *